US010989220B2

(12) United States Patent
Tanno et al.

(10) Patent No.: US 10,989,220 B2
(45) Date of Patent: Apr. 27, 2021

(54) CASING AND TURBO MACHINE

(71) Applicant: Hitachi, Ltd., Tokyo (JP)

(72) Inventors: Yohei Tanno, Tokyo (JP); Tomohiro Naruse, Tokyo (JP); Takeshi Kazama, Tokyo (JP); Ryuhei Tsukahara, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 175 days.

(21) Appl. No.: 16/329,075

(22) PCT Filed: Nov. 14, 2017

(86) PCT No.: PCT/JP2017/040844
§ 371 (c)(1),
(2) Date: Feb. 27, 2019

(87) PCT Pub. No.: WO2018/105329
PCT Pub. Date: Jun. 14, 2018

(65) Prior Publication Data

US 2019/0219065 A1 Jul. 18, 2019

(30) Foreign Application Priority Data

Dec. 6, 2016 (JP) ..... JP2016-236373

(51) Int. Cl.
*F04D 29/44* (2006.01)
*F04D 29/42* (2006.01)

(52) U.S. Cl.
CPC ..... *F04D 29/44* (2013.01); *F04D 29/42* (2013.01); *F04D 29/4213* (2013.01); *F05D 2240/12* (2013.01); *F05D 2260/60* (2013.01)

(58) Field of Classification Search
None
See application file for complete search history.

(56) References Cited

U.S. PATENT DOCUMENTS 10,344,729 B2 * 7/2019 Nishidono ..... F02M 35/10085
2005/0123410 A1 6/2005 Saitou et al.
2009/0205360 A1 8/2009 Haley et al.
(Continued)

FOREIGN PATENT DOCUMENTS

JP 7-24637 Y2 3/1991
JP 2002-147383 A 5/2002
JP 2002-235697 A 8/2002
(Continued)

OTHER PUBLICATIONS

International Search Report (PCT/ISA/210) issued in PCT Application No. PCT/JP2017/040844 dated Feb. 6, 2018 with English translation (four (4) pages).
(Continued)

*Primary Examiner* — Michael Lebentritt
(74) *Attorney, Agent, or Firm* — Crowell & Moring LLP

(57) ABSTRACT

A casing of a turbo machine includes a casing body having an inner space; an intake nozzle which is disposed on the casing body and through which a fluid is taken into the casing body; and a straightening vane disposed in the intake nozzle and having opposite ends located in a diameter direction of the intake nozzle. Only one of the opposite ends of the straightening vane is joined to an inner surface of the intake nozzle.

6 Claims, 6 Drawing Sheets

(56) References Cited

U.S. PATENT DOCUMENTS

2019/0055855 A1* 2/2019 Tanno ..... F04D 29/086

FOREIGN PATENT DOCUMENTS

| | | | |
|---|---|---|---|
| JP | 2005-163765 | A | 6/2005 |
| JP | 2007-32277 | A | 2/2007 |
| JP | 2008-175162 | A | 7/2008 |

OTHER PUBLICATIONS

Japanese-language Written Opinion (PCT/ISA/237) issued in PCT Application No. PCT/JP2017/040844 dated Feb. 6, 2018 (four (4) pages).

* cited by examiner

CASING AND TURBO MACHINE

TECHNICAL FIELD

The present invention relates to a casing and a turbo machine, and, in particular, related to a casing and a turbo machine having an intake nozzle in which a straightening vane is disposed.

BACKGROUND ART

A casing serving as an enclosure of a turbo machine has an intake nozzle through which a fluid is taken into the casing and a discharge nozzle through which a fluid is sent out to the outside of the casing. In general, the intake nozzle is provided with a straightening vane to straighten the fluid flowing from piping outside the casing.

Known examples of intake nozzles in each of which a straightening vane is disposed include the patent documents 1 and 2 described below. Patent document 1 states that "In a vertical shaft pump device having a vertical shaft pump 10 which is installed on a pump installation floor 14 above a suction water tank 16 and whose pump weight is supported on the pump installation floor 14, a straightening vane device 25 having straightening vanes for straightening the water flowing into a suction bell-mouth 12 of the vertical shaft pump 10 is installed on a bottom surface of the suction water tank 16, which located below an end of the suction bell-mouth 12. The suction bell-mouth 12 is fixed to the straightening vane device 25." (see the abstract).

Patent document 2 states that "The pump device 5 has a motor casing 22 made up of metal members and constituting a shell of an underwater motor 7. The motor casing 22 has a pump casing 30, a straightening vane hub 17, and straightening vanes 11 as constituent elements of the pump section. The pump casing 30, the straightening vane hub 17, and the straightening vanes 11 are integrally formed with a resin material." (see the abstract).

CITATION LIST

Patent Document

Patent document 1: Japanese Patent Application Laid Open No. 2002-147383

Patent document 2: Japanese Patent Application Laid Open No. 2007-32277

SUMMARY OF INVENTION

Technical Problem

As oil and gas industries evolve, there have been increasing demands for increasing the pressure and/or the size of turbo machines. The increase in the pressure and/or the size increases the load imposed on the casing. This causes an increase in the possibility of the casing being damaged and/or the possibility of leak of fluid from inside the casing. To improve the pressure bearing performance of the casing, in general, it is necessary to take measures such as reducing the stress that occurs in the casing, using high-strength materials for the casing, and improving the hermeticity of the casing. In particular, reduction of the stress that occurs in the casing is demanded.

In a turbo machine, fluid is compressed in the casing. As a result, the inner pressure is imposed against the casing, and thereby stress is generated in an intake nozzle and/or a straightening vane. In particular, stress applied to a straightening vane joined to an inner surface of the intake nozzle is likely to high. Therefore, to improve the pressure bearing performance of the casing, it is necessary to reduce the stress that occurs in a joint portion of the straightening vane.

The above-described patent documents 1 and 2 are known examples related to a turbo machine in which a straightening vane is provided but does not specifically describe techniques for reducing the stress that occurs in the straightening vane.

The present invention has been made taking into account the above-described circumstances of conventional techniques, and an object of the present invention is to provide a casing and a turbo machine which are capable of reducing the stress that occurs in a straightening vane with a simple structure to improve the pressure bearing performance.

Solution to Problem

To solve the above-described problems, an aspect of the present invention is a casing including: a casing body having an inner space; an intake nozzle which is disposed on the casing body and through which a fluid is taken into the casing body; and a straightening vane disposed in the intake nozzle and having opposite ends located in a diameter direction of the intake nozzle, wherein only one of the opposite ends of the straightening vane is joined to an inner surface of the intake nozzle.

An aspect of the present invention is a casing including: a casing body having an inner space; an intake nozzle which is disposed on the casing body and through which a fluid is taken into the casing body; a reinforcing rib disposed on an outer periphery of the intake nozzle; and a straightening vane disposed in the intake nozzle and having opposite ends located in a diameter direction of the intake nozzle, wherein both the opposite ends of the straightening vane are joined to an inner surface of the intake nozzle, the straightening vane has a slitted portion extending from a side of the straightening vane located on a casing body inner side toward an inlet of the intake nozzle, and the slitted portion has an end located on a side of the inlet of the intake nozzle, between the inlet of the intake nozzle and the reinforcing rib.

Another aspect of the present invention is a casing including: a casing body having an inner space; an intake nozzle which is disposed on the casing body and through which a fluid is taken into the casing body; a reinforcing rib disposed on an outer periphery of the intake nozzle; and a straightening vane disposed in the intake nozzle and having opposite ends located in a diameter direction of the intake nozzle, wherein at least one of the opposite ends of the straightening vane is joined to an inner surface of the intake nozzle, and the straightening vane is located between an inlet of the intake nozzle and the reinforcing rib.

A turbo machine according to the present invention includes a casing according to one of the above-described aspects of the present invention.

Advantageous Effects of Invention

The present invention can provide a casing and a turbo machine which are capable of reducing the stress that occurs in a straightening vane to improve the pressure bearing performance with a simple structure.

DESCRIPTION OF EMBODIMENTS

Embodiments of the present invention will now be described in detail with reference to the drawings.

First Embodiment

First, a first embodiment of the present invention will be described with reference to FIGS. 1 to 3.

Figure 1:
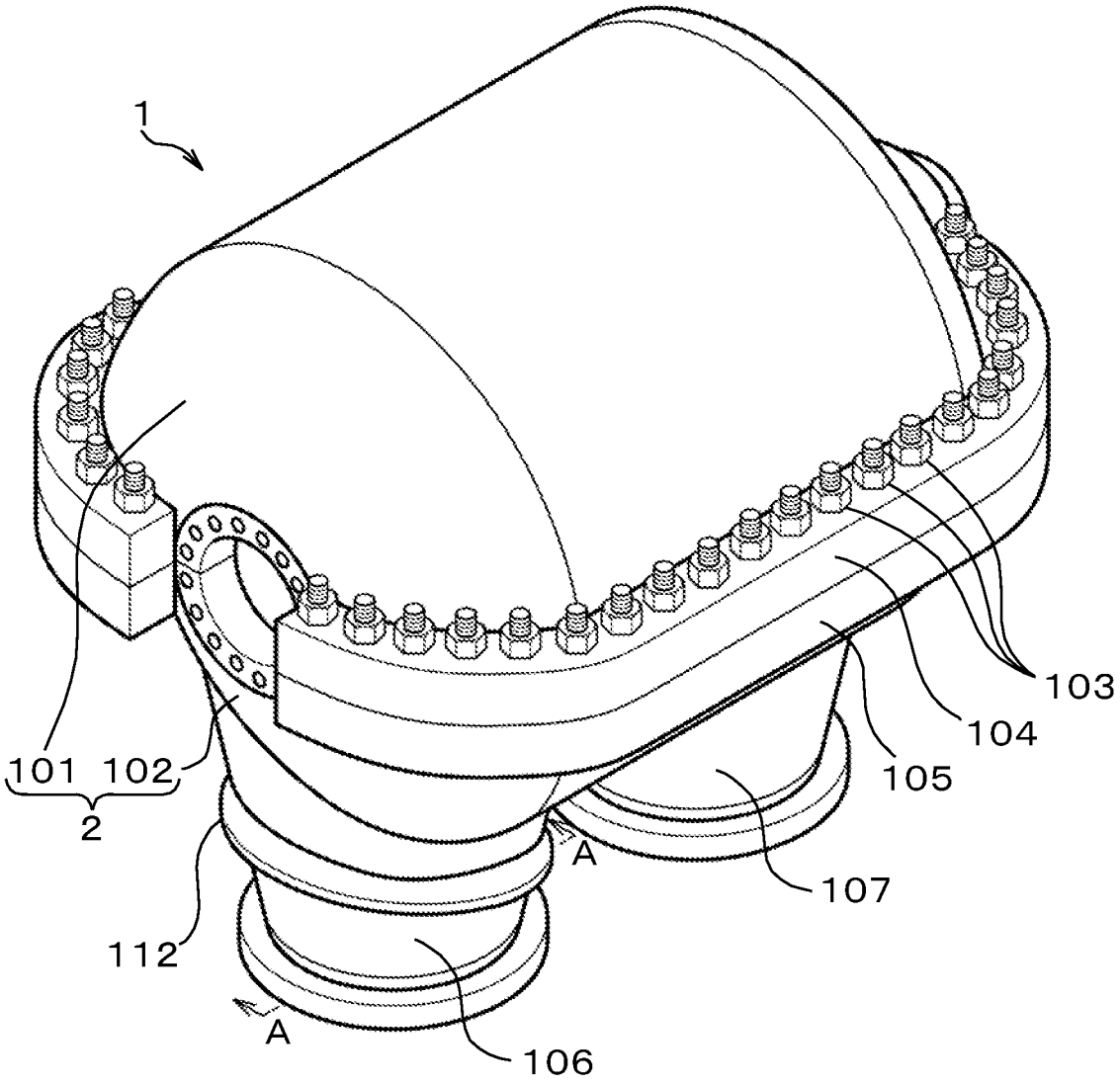
FIG. 1 is an external view of a casing according to a first embodiment of the present invention.
Figure 2A:
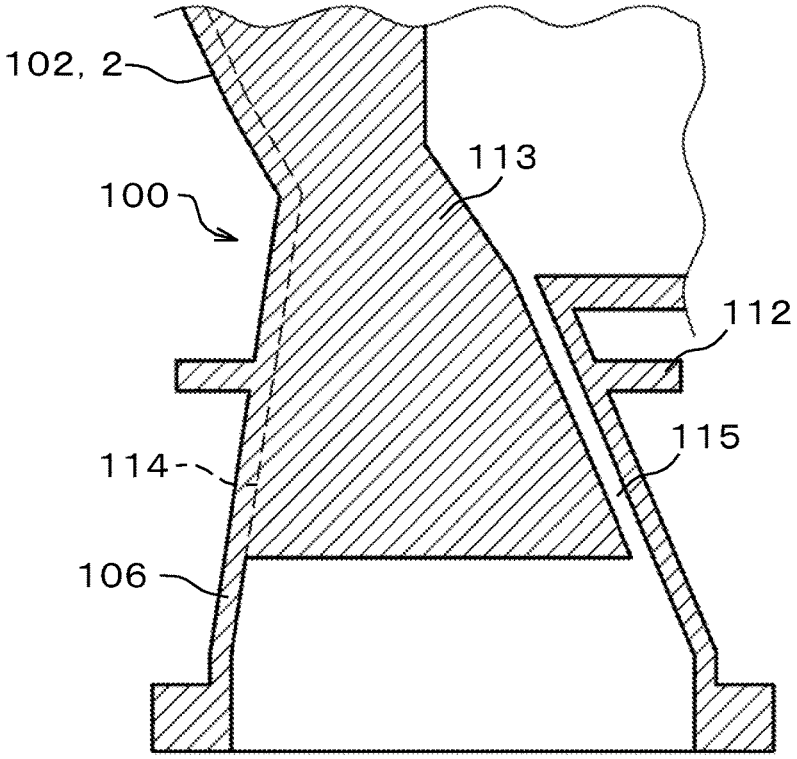
FIG. 2A is a cross-sectional view, taken along line A-A of FIG. 1, of an intake nozzle structure and its surrounding structure according to the first embodiment of the present invention.
Figure 2B:
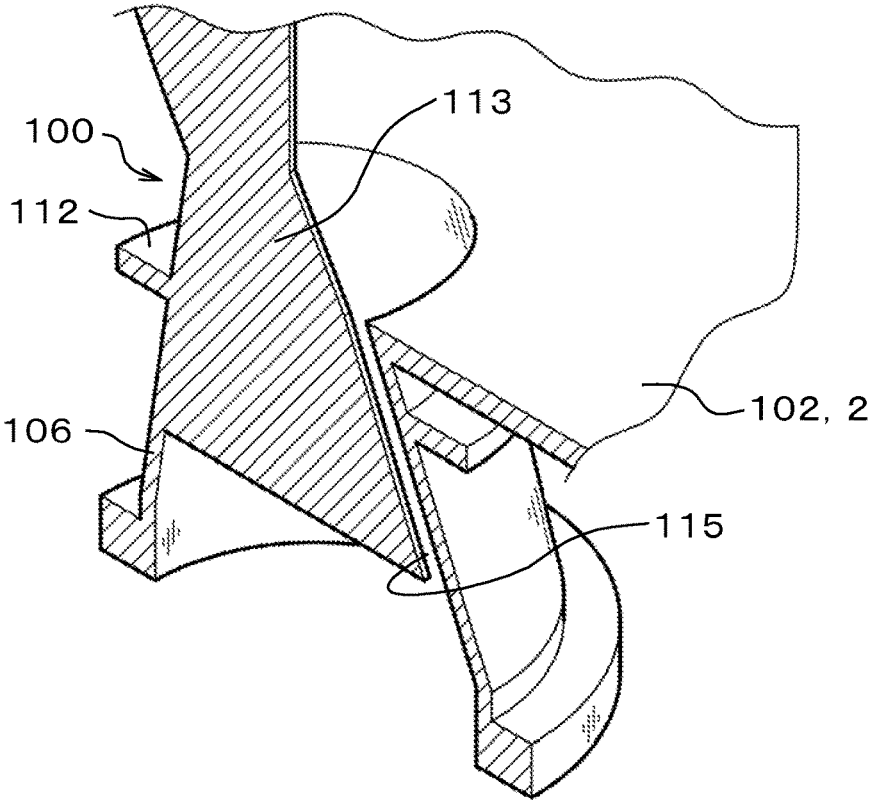
FIG. 2B is a perspective view corresponding to FIG. 2A.
Figure 3A:
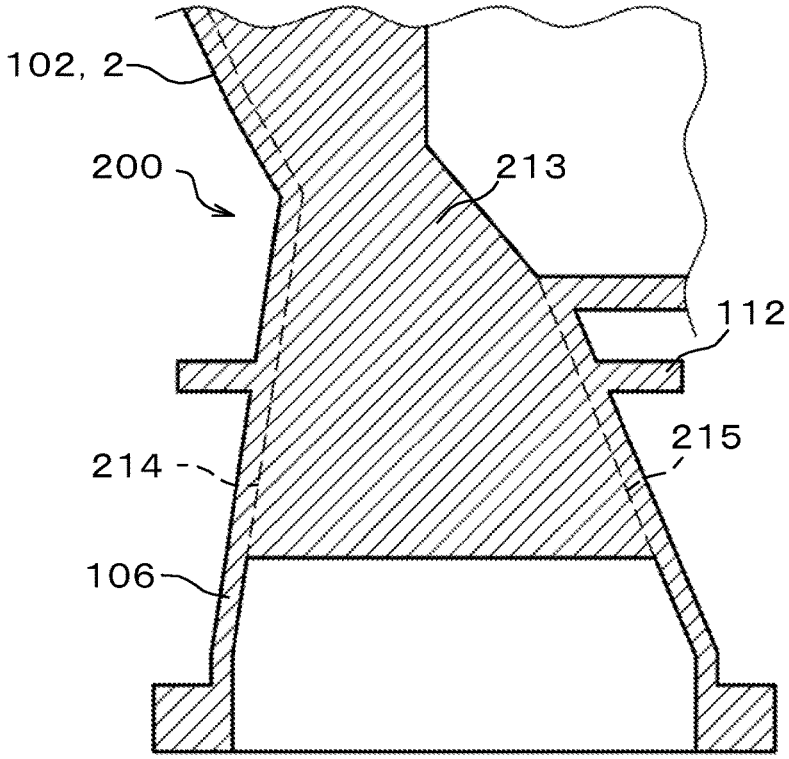
FIG. 3A is a cross-sectional view of an intake nozzle structure and its surrounding structure of a conventional intake nozzle structure according to a comparative example.
Figure 3B:
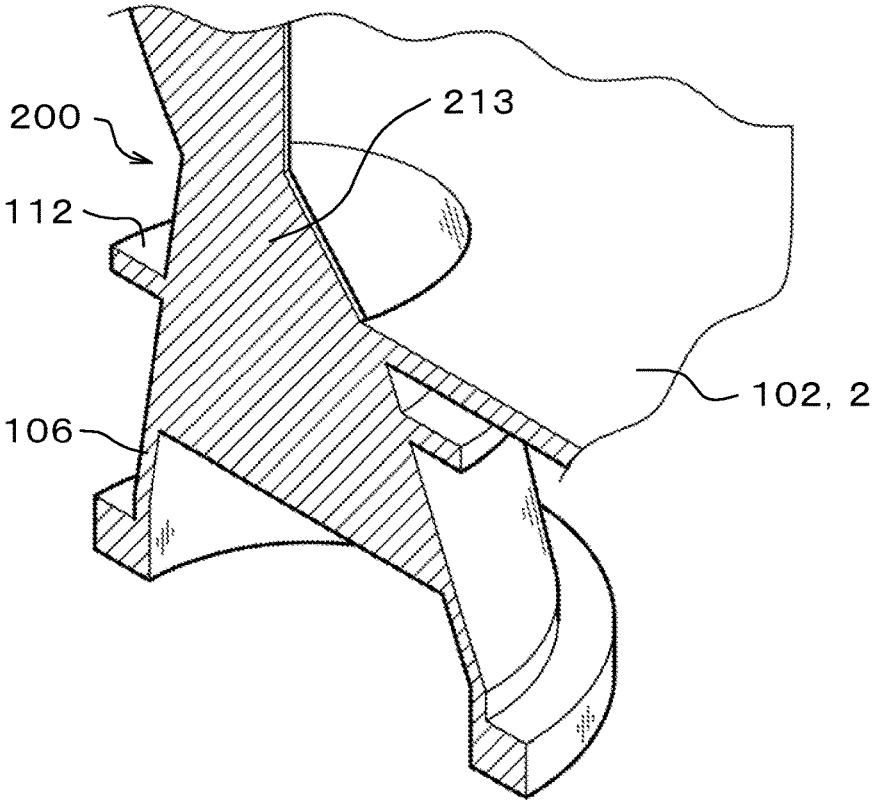
RELATED ART FIG. 3B
FIG. 3B is a perspective view corresponding to FIG. 3A.

FIG. 1 is an external view of a casing 1 according to the first embodiment of the present invention. FIG. 2A is a cross-sectional view, taken along line A-A of FIG. 1, of an intake nozzle structure 100 and its surrounding structure according to the first embodiment of the present invention. FIG. 2B is a perspective view corresponding to FIG. 2A. FIG. 3A is a cross-sectional view of an intake nozzle structure 200 and its surrounding structure according to a comparative example. FIG. 3B is a perspective view corresponding to FIG. 3A.

FIG. 1 illustrates the configuration of a horizontally split type casing 1 exemplified for a casing of a centrifugal compressor. The casing 1 includes a casing body 2 having an inner space. The casing body 2 has an upper casing 101 and a lower casing 102 which are vertically separated from each other across a horizontal plane.

A rotor system having an impeller, a shaft and the like is disposed between the upper casing 101 and the lower casing 102. The upper casing 101 has periphery portions with upper flanges 104. The lower casing 102 has periphery portions with lower flanges 105. The upper flanges 104 of the upper casing 101 and the lower flanges 105 of the lower casing 102 are fastened to each other with bolt members 103 to join the upper casing 101 to the lower casing 102 and seal hermetically the inside of the casing 1. With this structure, the high pressure gas in the casing 1 is sealed.

The lower casing 102 has an intake nozzle 106 and a discharge nozzle 107. A gas serving as the operational fluid is taken through the intake nozzle 106 into the casing body 2 of the casing 1. The pressure of the gas is increased by an impeller in the casing 1 and then sent out through the discharge nozzle 107 to the outside of the casing 1.

Herein, the lower casing 102, on which the intake nozzle 106 and the discharge nozzle 107 are formed, is presented as an example. However, the embodiment is not limited thereto. For example, the upper casing 101 may be configured to have the intake nozzle 106 and the discharge nozzle 107. Alternatively, the intake nozzle 106 may be formed on one of the upper casing 101 and the lower casing 102 and the discharge nozzle 107 may be formed on the other.

FIG. 2 shows the configuration of an intake nozzle structure 100 according to the first embodiment of the present invention.

As shown in FIG. 2, the intake nozzle structure 100 includes the intake nozzle 106, a reinforcing rib 112, and a straightening vane 113.

As shown in FIGS. 1 to 2, an upper portion of the intake nozzle 106 serves as a connection portion connecting between the intake nozzle 106 and the casing body 2 and has a shape slightly compressed in an axial direction of the casing body 2, for the convenience of piping outside the casing 1. To reinforce the intake nozzle 106 against the inner pressure load, the reinforcing rib 112 is formed on an outer periphery of the intake nozzle 106. The reinforcing rib 112 is a ring-shaped plate member formed to extend radially outward from the outer periphery of the intake nozzle 106. However, it should be noted that the first embodiment of the present invention is applicable even when the reinforcing rib 112 is not formed.

Disposed inside the intake nozzle 106 is the straightening vane 113 that straightens fluid gas flowing from the piping outside the casing 1. The straightening vane 113 is integrated with the intake nozzle 106 by welding or casting. The straightening vane 113 extends in a diameter direction of the intake nozzle 106. The straightening vane 113 is disposed in parallel with an axial direction of the casing body 2, but is not limited thereto. For example, the straightening vane 113 may be disposed perpendicular to the axial direction of the casing body 2.

In the intake nozzle structure 100 according to the first embodiment, the straightening vane 113 has opposite ends in the diameter direction (left-right direction on the drawing plane of FIG. 2A) of the intake nozzle 106. Only one of the opposite ends is joined to an inner surface of the intake nozzle 106.

Hereinafter, left and right on the drawing plane of FIG. 2A is simply referred to as left and right respectively (the same applies to FIG. 3A, FIG. 4A, FIG. 5A and FIG. 6A).

That is, the intake nozzle 106 and the straightening vane 113 are joined to each other along a border portion 114 (indicated by the dashed line in FIG. 2A) between the left inner surface of the intake nozzle 106 and the straightening vane 113. On the opposite side of the border portion 114 (on the right inner surface of the intake nozzle 106 in FIG. 2A), a slitted portion 115 is formed so that the intake nozzle 106 and the straightening vane 113 are not joined to each other.

FIG. 3 shows the configuration of an intake nozzle structure 200 according to a comparative example.

As shown in FIG. 3, the intake nozzle structure 200 includes the intake nozzle 106, the reinforcing rib 112, and a straightening vane 213.

The difference between the intake nozzle structure 100 according to the first embodiment shown in FIG. 2 and the intake nozzle structure 200 according to the comparative example shown in FIG. 3 is as follows. In the intake nozzle structure 100, the slitted portion 115 is formed between the right inner surface of the intake nozzle 106 and the straightening vane 113 so that they are not joined to each other. In contrast, in the intake nozzle structure 200, the intake nozzle 106 and the straightening vane 213 are joined to each other along a border portion 215 (indicated by the dashed line in FIG. 3A) between the right inner surface of the intake nozzle 106 and the straightening vane 213.

In other words, in the intake nozzle structure 200 according to the comparative example shown in FIG. 3, left and right opposite ends of the straightening vane 213 are both joined to the intake nozzle 106 on a border portion 214 and the border portion 215. With this structure, when inner pressure is applied on both the casing 1 and the intake nozzle 106, the intake nozzle 106 expands in a diameter direction thereof and thereby the straightening vane 213 is pulled in the left and right directions. As a result, a high stress may possibly be generated in the vicinity of the left and right border portions 214 and 215, where the straightening vane 213 is joined to the inner surface of the intake nozzle 106.

In contrast, in the intake nozzle structure 100 according to the first embodiment shown in FIG. 2, only the left end of the straightening vane 113 is joined to the inner surface of the intake nozzle 106 along the border portion 114 and the right end of the straightening vane 113 is not joined to the inner surface of the intake nozzle 106. As a result, even when the intake nozzle 106 expands due to the inner pressure of the casing 1, the straightening vane 113 merely moves following the deformation of the intake nozzle 106. In the intake nozzle structure 200 according to the comparative example, all the members of the intake nozzle 106, the reinforcing rib 112, and the straightening vane 213 are deformed due to the inner pressure of the casing 1. In contrast, in the intake nozzle structure 100 according to the first embodiment, only the intake nozzle 106 and the reinforcing rib 112 are deformed but the straightening vane 113 is hardly deformed. Therefore, adoption of the intake nozzle structure 100 according to the first embodiment reduces the stress that occurs in the straightening vane 113.

In addition, the shape of the straightening vane 113 of the intake nozzle structure 100 according to the first embodiment is almost the same as the shape of the straightening vane 213 of the intake nozzle structure 200 according to the comparative example. Therefore, even the intake nozzle structure 100 fully provides the gas straightening effect.

Incidentally, in the intake nozzle structure 100 shown in FIG. 2, although only the left end of the straightening vane 113 is joined to the inner surface of the intake nozzle 106 along the border portion 114, only the right end of the straightening vane 113 may be joined to the inner surface of the intake nozzle 106. In FIG. 2, the slitted portion 115 is formed in a straight, parallel shape along the inclination of the inner surface of the intake nozzle 106. However, the slitted portion 115 can have any shape and inclination.

As described above, the intake nozzle structure 100 according to the first embodiment reduces the deformation and stress that occur in the straightening vane 113, by causing members other than the straightening vane 113 such as the reinforcing rib 112 and the intake nozzle 106 to substantially solely bear the burden of resisting being deformed (distorted) due to the inner pressure.

Therefore, the first embodiment can provide a casing 1 and a centrifugal compressor which are capable of reducing the stress that occurs in the straightening vane 113 to improve the pressure bearing performance thereof with a simple structure, while maintaining the straightening effect on the fluid flow in the intake nozzle 106.

Second Embodiment

Next, a second embodiment of the present invention is described with reference to FIG. 4.

Figure 4A:
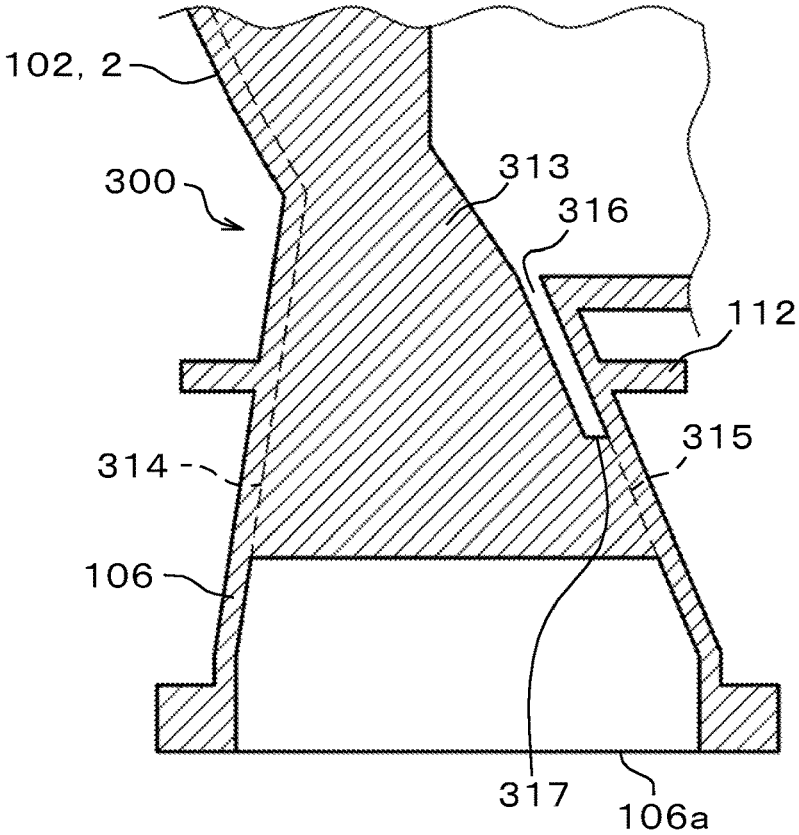
FIG. 4A is a cross-sectional view of an intake nozzle structure and its surrounding structure according to a second embodiment of the present invention.
Figure 4B:
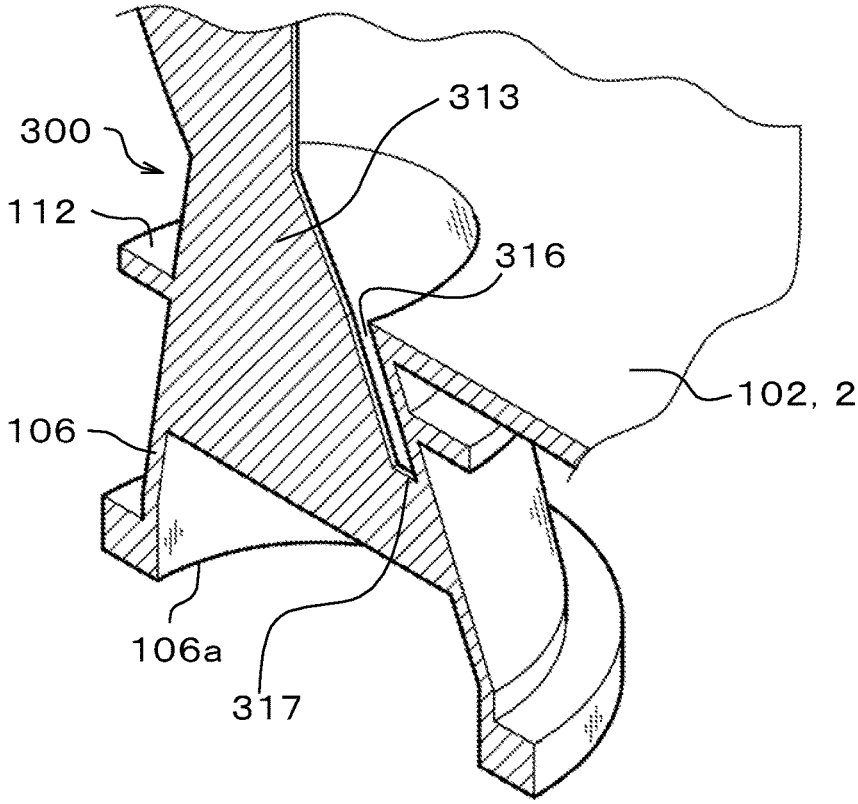
FIG. 4B is a perspective view corresponding to FIG. 4A.

FIG. 4A is a cross-sectional view of an intake nozzle structure 300 and its surrounding structure according to the second embodiment of the present invention. FIG. 4B is a perspective view corresponding to FIG. 4A.

FIG. 4 shows the configuration of the intake nozzle structure 300 according to the second embodiment of the present invention.

Some of the elements of the intake nozzle structure 300 have the same structures and functions as those of the already described intake nozzle structure 100 shown in FIG. 2. Description of such elements will be omitted.

The intake nozzle structure 300 according to the second embodiment shown in FIG. 4 differs from the intake nozzle structure 100 according to the first embodiment shown in FIG. 2 in the following point. The intake nozzle structure 300 has a straightening vane 313 whose opposite ends located in the diameter direction (left-right direction on the drawing plane of FIG. 4A) of the intake nozzle 106 are jointed to the inner surface of the intake nozzle 106 on border portions 314 and 315 respectively. In addition, the straightening vane 313 has a slitted portion 316 extending from a portion of the straightening vane 313 located on the inner side of the casing body 2 toward an inlet 106*a* of the intake nozzle 106. The slitted portion 316 has an end 317 located on the side of the inlet 106*a* of the intake nozzle 106, between the inlet 106*a* and the reinforcing rib 112.

In the intake nozzle structure 300, the slitted portion 316 is partially formed on the right side of the straightening vane 313. The straightening vane 313 and the intake nozzle 106 are joined to each other on the border portion 315. The end 317 of the slitted portion 316 is located below the reinforcing rib 112 (on the side of the inlet 106*a* of the intake nozzle 106). The inner pressure of the casing 1 operates to cause deformation of the slitted portion 316 in such a manner that the slit width of the slitted portion 316 is enlarged. However, the reinforcing rib 112 and the intake nozzle 106 is made to bear the burden of resisting being deformed, and, as a result, the deformation of the slitted portion 316 is reduced.

In this manner, like the intake nozzle structure 100 according to the first embodiment shown in FIG. 2, the intake nozzle structure 300 according to the second embodiment shown in FIG. 4 reduces the deformation and the stress that occur in the straightening vane 313, by causing members other than the straightening vane 313 such as the reinforcing rib 112 and the intake nozzle 106 to substantially solely bear the burden of resisting being deformed due to the inner pressure.

Therefore, even the second embodiment enjoys the same working effects as those of the first embodiment.

In the intake nozzle structure 100 according to the first embodiment, the slitted portion 115 extends the entire length of the right side of the straightening vane 113. That is, only a single end side of the straightening vane 113 is held. As a result, the straightening vane 113 may possibly vibrate somewhat due to the load imposed by the fluid flowing through the intake nozzle 106. In addition, a fluid flowing on one side (front surface side) of the straightening vane 113 and a fluid flowing on the other side (rear surface side) of the straightening vane 113 may possibly interfere with each other through the slitted portion 115. As a result, the straightening effect on the fluids may possibly be reduced somewhat. On the other hand, in the intake nozzle structure 300 according to the second embodiment, as the straightening vane 313 and the intake nozzle 106 are joined to each other along the border portion 315, the vibration of the straightening vane 313 due to the fluid load is inhibited, and the interference between the fluid flowing on the front surface side of the straightening vane 313 and the fluid flowing on the rear surface side of the straightening vane 313 can be reduced.

Incidentally, although the slitted portion 316 is formed on the right side of the straightening vane 313 in the intake nozzle structure 300, it may be formed on the left side of the straightening vane 313. Referring to FIG. 4, the slitted portion 316 is formed in a straight, parallel shape along the inclination of the inner surface of the intake nozzle 106, the slitted portion 316 can have any shape and inclination.

Third Embodiment

Next, a third embodiment of the present invention is described with reference to FIG. 5.

Figure 5A:
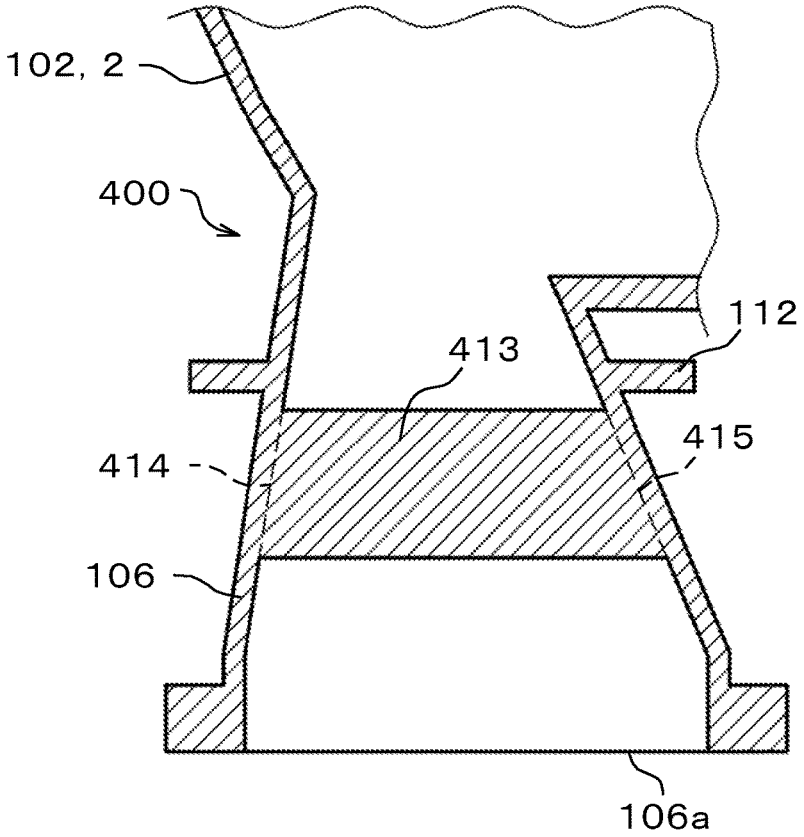
FIG. 5A is a cross-sectional view of an intake nozzle structure and its surrounding structure according to a third embodiment of the present invention.
Figure 5B:
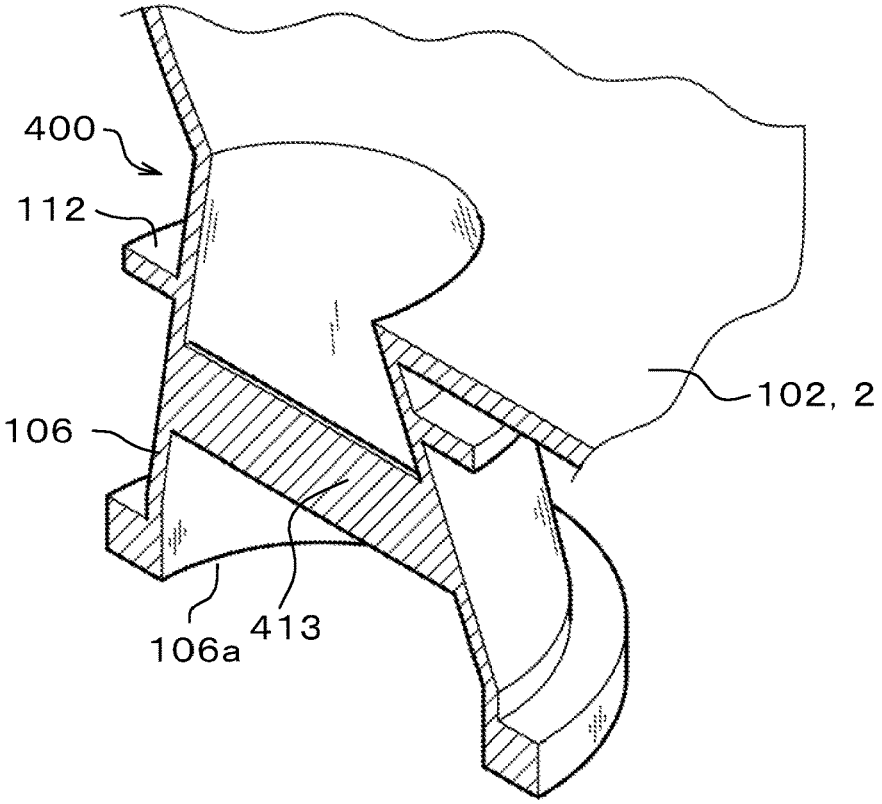
FIG. 5B is a perspective view corresponding to FIG. 5A.

FIG. 5A is a cross-sectional view of an intake nozzle structure 400 and its surrounding structure according to the third embodiment of the present invention. FIG. 5B is a perspective view corresponding to FIG. 5A.

FIG. 5 shows the configuration of the intake nozzle structure 400 according to the third embodiment of the present invention.

Some of the elements of the intake nozzle structure 400 have the same structures and functions as those of the already described intake nozzle structure 300 shown in FIG. 4. Description of such elements will be omitted.

The intake nozzle structure 400 according to the third embodiment shown in FIG. 5 differs from the intake nozzle structure 300 according to the second embodiment shown in FIG. 4 in the following point. The intake nozzle structure 400 has a straightening vane 413 whose opposite ends located in the diameter direction (left-right direction on the drawing plane of FIG. 5A) of the intake nozzle 106 are joined to the inner surface of the intake nozzle 106. In addition, the straightening vane 413 is located between the inlet 106*a* and the reinforcing rib 112 of the intake nozzle 106.

In other words, in the intake nozzle structure 400, any portion of the straightening vane 413 is located below the reinforcing rib 112 (on the side of inlet 106*a* of the intake nozzle 106). In addition, the left and right opposite ends of the straightening vane 413 are both joined to the inner surface of the intake nozzle 106 on border portions 414 and 415.

In this manner, like the intake nozzle structure 300 according to the second embodiment shown in FIG. 4, the intake nozzle structure 400 according to the third embodiment shown in FIG. 5 reduces the deformation and the stress that occur in the straightening vane 413, by causing members other than the straightening vane 413 such as the reinforcing rib 112 and the intake nozzle 106 to substantially solely bear the burden of resisting being deformed due to the inner pressure.

Therefore, the third embodiment enjoys the same working effects as those of the second embodiment.

In the above-described intake nozzle structures 100 and 300, the straightening vanes 113 and 313 are each joined to the intake nozzle 106 over a long length along the border portion 114 and thus the processing cost may possibly be increased somewhat. On the other hand, in the intake nozzle structure 400 according to the third embodiment, when the straightening vane 413, which is located below the reinforcing rib 112 (on the side of inlet 106*a* of the intake nozzle 106), can provide a sufficient straightening effect, the area of the straightening vane 413 and the joining area can be reduced. As a result, the material cost and the processing cost can be reduced.

Incidentally, the intake nozzle structure 400 according to the third embodiment has a smaller joining area than the intake nozzle structure 100 according to the first embodiment. For this reason, taking into account the vibration of the straightening vane 413 that may occur due to a fluid load, the left and right ends of the straightening vane 413 are both joined to the inner surface of the intake nozzle 106 on the border portions 414 and 415. However, if the influence of the vibration due to the fluid load is small, only one of the left and right ends of the straightening vane 413 may be joined to the inner surface of the intake nozzle 106.

Fourth Embodiment

Next, a fourth embodiment of the present invention is described with reference to FIG. 6.

Figure 6A:
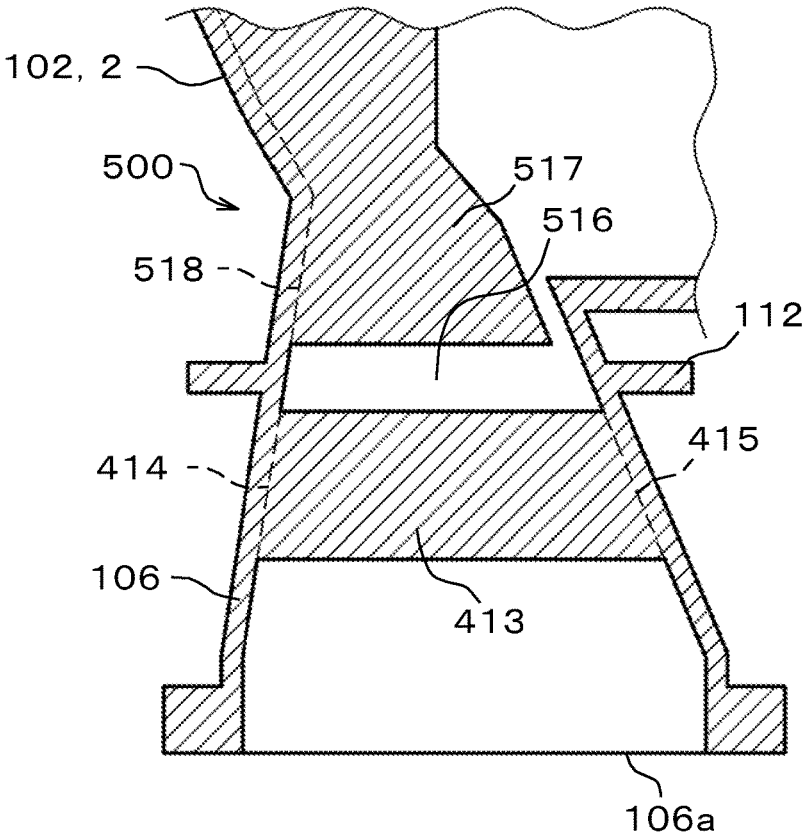
FIG. 6A is a cross-sectional view of an intake nozzle structure and its surrounding structure according to a fourth embodiment of the present invention.
Figure 6B:
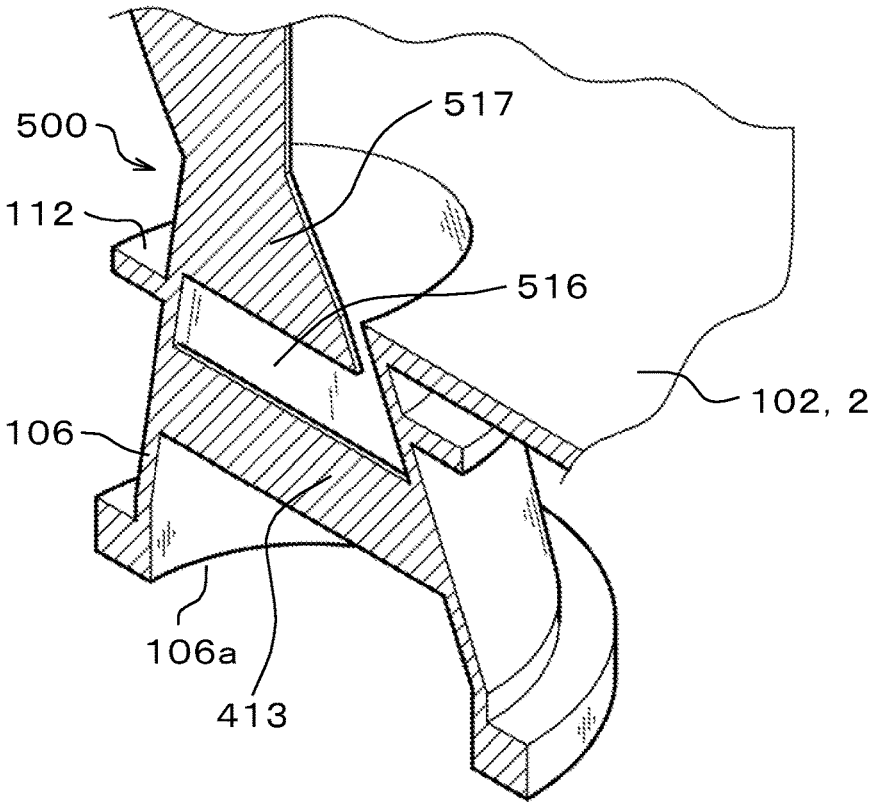
FIG. 6B is a perspective view corresponding to FIG. 6A.

FIG. 6A is a cross-sectional view of an intake nozzle structure 500 and its surrounding structure according to the fourth embodiment of the present invention. FIG. 6B is a perspective view corresponding to FIG. 6A.

FIG. 6 shows the configuration of the intake nozzle structure 500 according to the fourth embodiment of the present invention.

Some of the elements of the intake nozzle structure 500 have the same structures and functions as those of the already described intake nozzle structure 400 shown in FIG. 5. Description of such elements will be omitted.

The intake nozzle structure 500 according to the fourth embodiment shown in FIG. 6 differs from the intake nozzle structure 400 according to the third embodiment shown in FIG. 5 in the following point. The intake nozzle structure 500 has another straightening vane 517 located on the inner side of the casing body 2 with respect to the reinforcing rib 112. The straightening vane 517 has opposite ends in the diameter direction (left-right direction on the drawing plane of FIG. 6A) of the intake nozzle 106. Only one of the opposite ends is joined to the inner surface of the intake nozzle 106.

In the intake nozzle structure 500, like the intake nozzle structure 400 according to the third embodiment shown in FIG. 5, the straightening vane 413 is located below the reinforcing rib 112 (on the side of inlet 106*a* of the intake nozzle 106). Moreover, the another straightening vane 517 is located above the straightening vane 413 with a slitted portion 516 extending in the horizontal direction interposed therebetween. The left and right opposite ends of the straightening vane 413 are both joined to the inner surface of the intake nozzle 106 along the border portions 414 and 415. On the other hand, only the left end of the another straightening vane 517 is joined to the inner surface of the intake nozzle 106 along a border portion 518, and the opposite right end is not joined to the inner surface of the intake nozzle 106.

In this manner, like the intake nozzle structure 400 according to the third embodiment shown in FIG. 5, the intake nozzle structure 500 according to the fourth embodiment shown in FIG. 6 reduces the deformation and the stress that occur in the straightening vanes 413 and 517, by causing members other than the straightening vanes 113 and 517 such as the reinforcing rib 112 and the intake nozzle 106 to substantially solely bear the burden of resisting being deformed due to the inner pressure.

Therefore, the fourth embodiment enjoys the same working effects as those of the third embodiment.

Even when the intake nozzle structure 400 according to the third embodiment fails to provide a sufficient straightening effect with the straightening vane 413 only, the intake nozzle structure 500 according to the fourth embodiment can improve the straightening effect because the total area of straightening vanes is increased by disposing the another straightening vane 517.

Incidentally, in the intake nozzle structure 500 according to the fourth embodiment, the left and right ends of the straightening vane 413 are both joined to the inner surface of the intake nozzle 106 along the border portions 414 and 415. However, only one of the left and right ends of the straightening vane 413 may be joined to the inner surface of the intake nozzle 106.

Moreover, in the intake nozzle structure 500, only the left end of the another straightening vane 517 is joined to the inner surface of the intake nozzle 106 along the border portion 518. However, only the right end of the another straightening vane 517 may be joined to the inner surface of the intake nozzle 106. Moreover, the another straightening vane 517 may include a plurality of straightening vanes.

The present invention has been described above based on the embodiments, but is not limited to the embodiments and includes various modifications. For example, the above-described embodiment has been described in detail in order to better illustrate the present invention and are not necessarily limited to the one having an entire configuration as described above. In addition, a part of the configuration of a certain embodiment may be replaced with a part of the configuration of another embodiment, and the configuration of a certain embodiment may be added with a configuration of another embodiment. Further, a part of the configuration in each of the embodiments may be eliminated, added or replaced with other configuration.

For example, the casing 1 of the above-described embodiments is applied to a centrifugal compressor, but it is not limited thereto and it can be applied to turbo machines such as compressors and pumps having casings on which inner pressure is imposed.

REFERENCE SIGNS LIST

1 casing
2 casing body
100 intake nozzle structure
101 upper casing
102 lower casing
103 bolt member
104 upper flange
105 lower flange
106 intake nozzle
106*a* inlet
107 discharge nozzle
112 reinforcing rib
113 straightening vane
114 border portion
115 slitted portion
300 intake nozzle structure
313 straightening vane
314, 315 border portion
316 slitted portion
317 end
400 intake nozzle structure
413 straightening vane
414, 415 border portion
500 intake nozzle structure
516 slitted portion
517 another straightening vane
518 border portion

The invention claimed is:

1. A casing comprising:
a casing body having an inner space;
an intake nozzle which is disposed on the casing body and through which a fluid is taken into the casing body;
a reinforcing rib disposed on an outer periphery of the intake nozzle; and
a straightening vane disposed in the intake nozzle and having opposite ends located in a diameter direction of the intake nozzle,
wherein both the opposite ends of the straightening vane are joined to an inner surface of the intake nozzle,
wherein the straightening vane has a slitted portion extending from a side of the straightening vane located on a casing body inner side toward an inlet of the intake nozzle, and
wherein the slitted portion has an end located on a side of the inlet of the intake nozzle, between the inlet of the intake nozzle and the reinforcing rib.

2. A casing comprising:
a casing body having an inner space;
an intake nozzle which is disposed on the casing body and through which a fluid is taken into the casing body;
a reinforcing rib disposed on an outer periphery of the intake nozzle; and
a straightening vane disposed in the intake nozzle and having opposite ends located in a diameter direction of the intake nozzle,
wherein at least one of the opposite ends of the straightening vane is joined to an inner surface of the intake nozzle, and
wherein the straightening vane is located between an inlet of the intake nozzle and the reinforcing rib.

3. The casing of claim 2, further comprising another straightening vane disposed in the intake nozzle and having opposite ends located in the diameter direction of the intake nozzle, the another straightening vane located on the inner side of the casing body with respect to the reinforcing rib,
wherein only one of the opposite ends of the another straightening vane is joined to the inner surface of the intake nozzle.

4. A turbo machine comprising the casing according to claim 1.

5. A turbo machine comprising the casing according to claim 2.

6. A turbo machine comprising the casing according to claim 3.

* * * * *